US005199200A

United States Patent [19]

Howell

[11] Patent Number: 5,199,200

[45] Date of Patent: Apr. 6, 1993

[54] MARBLE PICTURE FRAME

[76] Inventor: David Howell, 333 Hook Rd., Katonah, N.Y. 10536

[21] Appl. No.: 919,206

[22] Filed: Jul. 24, 1992

[51] Int. Cl.[5] ..... G09F 1/12

[52] U.S. Cl. ..... 40/152

[58] Field of Search ..... 40/152, 152.1, 156, 40/124.4; D6/300

[56] References Cited

U.S. PATENT DOCUMENTS

| | | | |
|---|---|---|---|
| D. 113,000 | 6/1939 | Jestema | D6/300 |
| 268,870 | 12/1882 | Currier | 40/152 |
| 369,410 | 9/1887 | Pratt | 40/152 |
| 501,262 | 7/1893 | Walker | 40/152.1 |
| 1,202,589 | 10/1916 | Roosman | 40/152.1 |

FOREIGN PATENT DOCUMENTS

| | | | |
|---|---|---|---|
| 415158 | 9/1946 | Italy | 40/152 |
| 356557 | 9/1931 | United Kingdom | 40/152 |

*Primary Examiner*—Rodney M. Lindsey
*Assistant Examiner*—F. Saether
*Attorney, Agent, or Firm*—Wall and Roehrig; Thomas J. Wall

[57] ABSTRACT

A picture frame has a front grid member and a back grid member, with an arrangement of marbles or similar spheres or spheroids retained between the grid members at a central picture opening. A cast zinc one-piece picture holder is secured in place with double-sided tape.

15 Claims, 6 Drawing Sheets

MARBLE PICTURE FRAME

BACKGROUND OF THE INVENTION

This invention relates to decorative display devices, such as picture frames, and is more particularly concerned with a frame having elements which in combination produce a novel visual effect.

Frame construction for a picture, poster, art work, or other two dimensional subject traditionally comprises four frame elements which hold the artwork sandwiched between a front glass plate and a frame back. While many frames have been embellished with carvings, moldings, and the like, the embellishments tend to be surface features or features carved or molded directly into the frame elements.

No one has previously achieved a dramatic, attractive visual effect in the frame itself by constructing a frame of separate elements sandwiched together.

OBJECTS AND SUMMARY OF THE INVENTION

Accordingly, it is an object of this invention to provide a picture frame which produces a visual effect that was unachieveable in the picture frames of the prior art.

It is a more specific object to provide a picture frame which incorporates transparent elements that play on the aesthetic effects of light in the environment where the picture is displayed.

It is also an object of this invention to provide an improved picture frame of elegantly simple construction, combining the attributes of both beauty and ruggedness.

According to one aspect of this invention, a picture frame has a front grid member which is in the form of intersecting strips which define a plurality of grid openings in a margin area that surrounds a picture opening. These grid openings have a predetermined grid spacing between adjacent ones of the openings and a predetermined opening size across each of them. A back grid member has a similar arrangement of intersecting strips to define a similar plurality of grid openings in the margin that surrounds the back grid member picture opening. Sandwiched between these two grid members are a plurality of solid geometrical members, generally referred to herein as beads. Here these can be spheroids, e.g., marbles, spheres of glass, translucent plastic, ceramic, or any other material, and these are retained in an array between the front and back grid members, with each of the spheroids being held in place in a respective grid opening. In this case, the beads or spheroids are of a predetermined diameter that is between the grid opening size and the grid spacing size.

Fastener means, such as threaded posts, hold the front and back grid members in registry with one another with the beads, i.e., spheroids disposed between them. A picture holder member is secured onto one of the grid members, to wit, the back grid member, at its picture opening. The picture holder member is adapted to receive the displayed picture or art work, which can be sandwiched between a front glass plate and a rear frame back or similar member. In a preferred embodiment, the picture holder includes a one-piece casting e.g. of zinc or zinc alloy. This picture holder has a rectangular front member which has a front flat surface, and a retaining wall formed on three sides of the rectangular member, with a fourth side being open to receive the picture, the associated glass plate, and the backing members. Also in a preferred embodiment, the one-piece casting is secured onto the back grid member with double sided tape, that is, tape which has adhesive on both surfaces to bond the picture holder to the back grid member. Preferably, the strips which define the central picture opening for the back frame member are somewhat wider than the corresponding rectangular member of the picture holder casting, and project somewhat towards the center. In this fashion, these picture opening strips serve as a front retaining member to hold the glass and picture in place within the picture holder.

The above and many other objects, features, and advantages of this invention will be described in detail with reference to the preferred embodiment, which should be read in conjunction with the accompanying Drawing.

DETAILED DESCRIPTION OF THE PREFERRED EMBODIMENT

Figure 1:
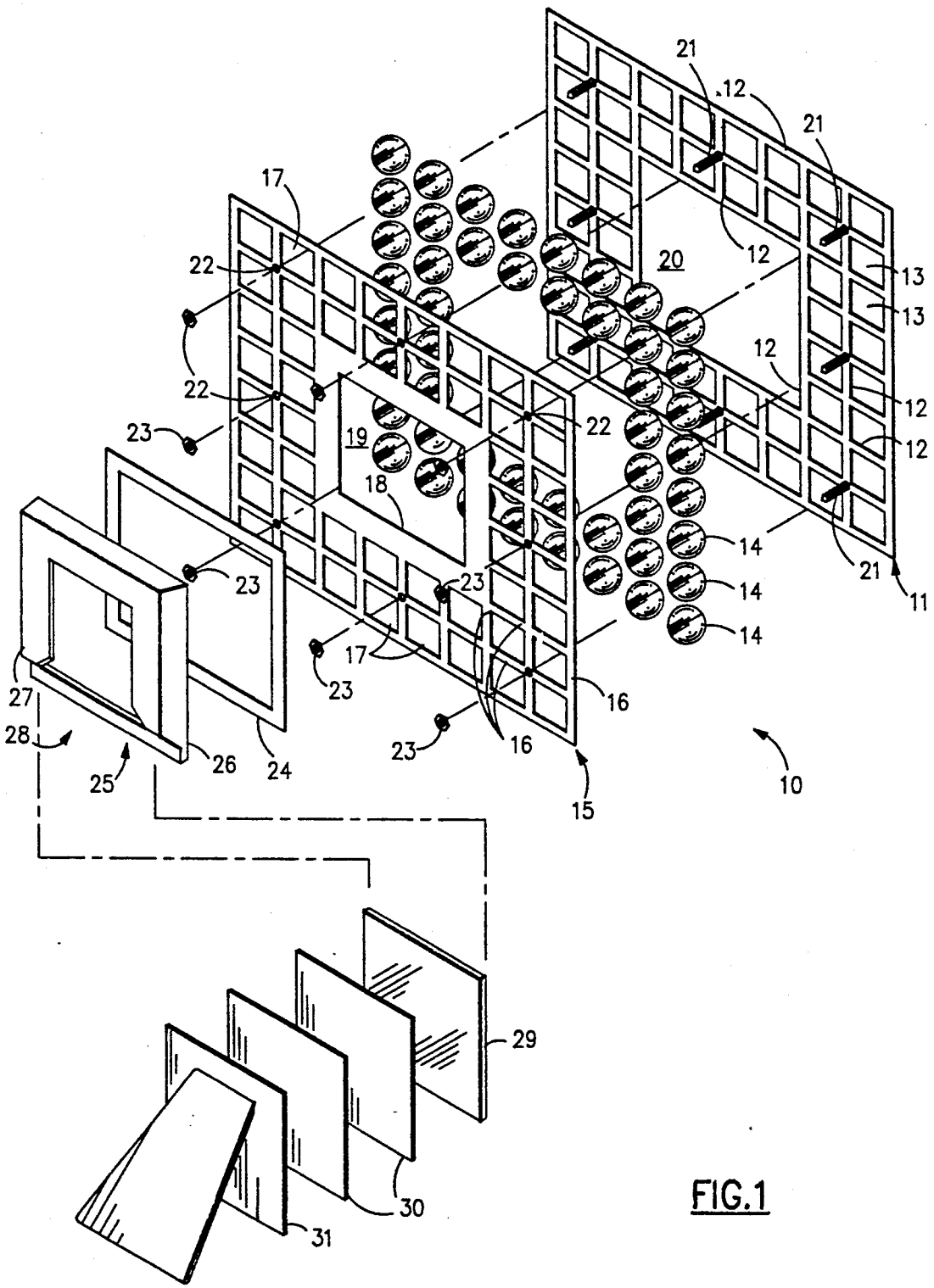
FIG. 1 is an exploded perspective assembly view of a picture frame according to one preferred embodiment of this invention.

With reference to the Drawing, and initially to FIGS. 1–6, a picture frame 10 constructed according to this invention is shown to have a rectangular front grid 11 which is in the form of elongated strips or webs 12 which intersect one another at right angles forming a rectangular lattice to define a plurality of square openings 13. Considered either vertically or horizontally, the openings 13 are arranged at a predetermined spacing or center-to-center distance, and also each have a predetermined opening size, i.e., from side to side or up and down between successive strips 12. Next shown in the Drawing are a plurality of glass marbles 14, here serving as an example of an arrangement of spheroids. Rather, than glass marbles, plastic spheres or ceramic spheres could be used, either solid or hollow, and having translucent or opalescent characteristics. Further, metallic spheres could be used in other embodiments. The marbles or spheroids 14 have a diameter which is greater than the opening size of the openings 13, but is smaller than the spacing between centers of successive openings, so that the marbles or spheroids 14 will be held in respective ones of the openings 13.

Figure 4:
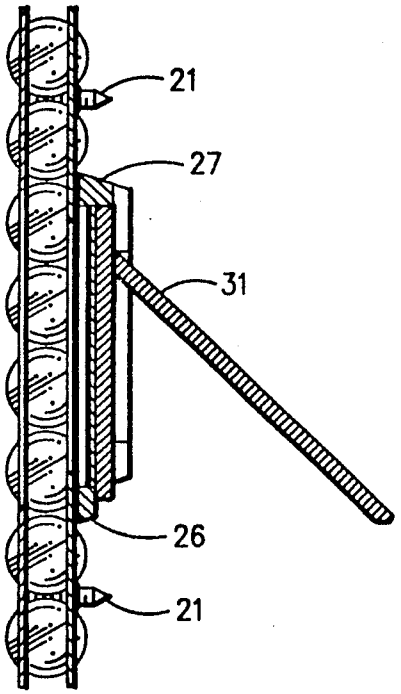
FIG. 4 is a sectional elevation of this embodiment.
Figure 3:
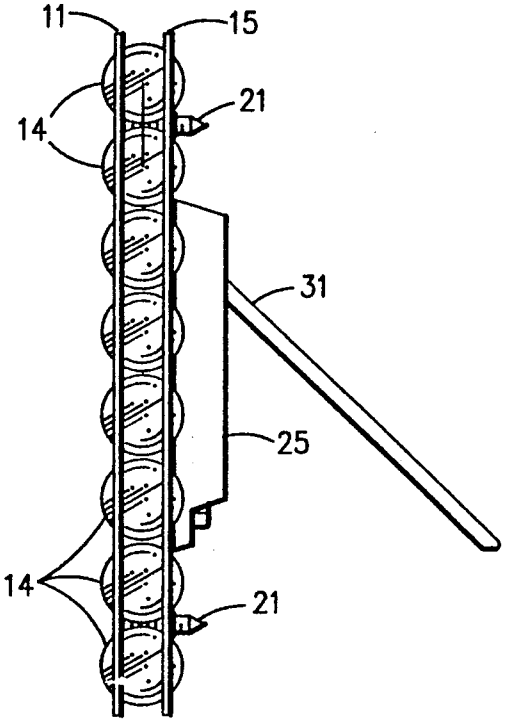
FIG. 3 is a side elevation of this embodiment.
Figure 2:
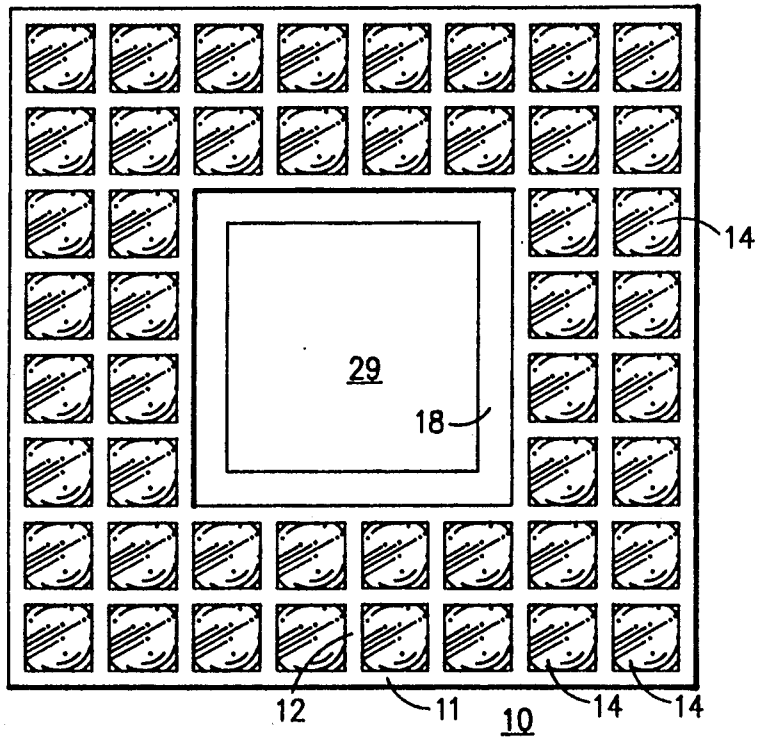
FIG. 2 is a front elevation of the picture frame of this embodiment.

A back grid member 15 is similarly formed of a plurality of intersecting elongated strips 16, defining square openings 17. In this case there are somewhat wider webs 18 at the center of the back grid member, and these define a back picture opening 19. As shown in FIGS. 2–4, these spheroids 14 are sandwiched between the front and back grid members 11 and 15, with the openings 17 in registry with the openings 13. Also, the back picture opening 19 is in registry with a corresponding front picture opening 20 in the front grid member.

In this embodiment, there are threaded posts 21 secured onto a proximal side of the front grid member 11, e.g. by welding or soldering, and these project through holes or openings 22 at corresponding positions at intersection of the strips in the back grid member 15. Then, the front grid member, the spheroids, and the back grid member are secured together by nuts 23 which screw down onto the threaded posts 21. In other embodiments, other securing means can be employed.

Figure 5:
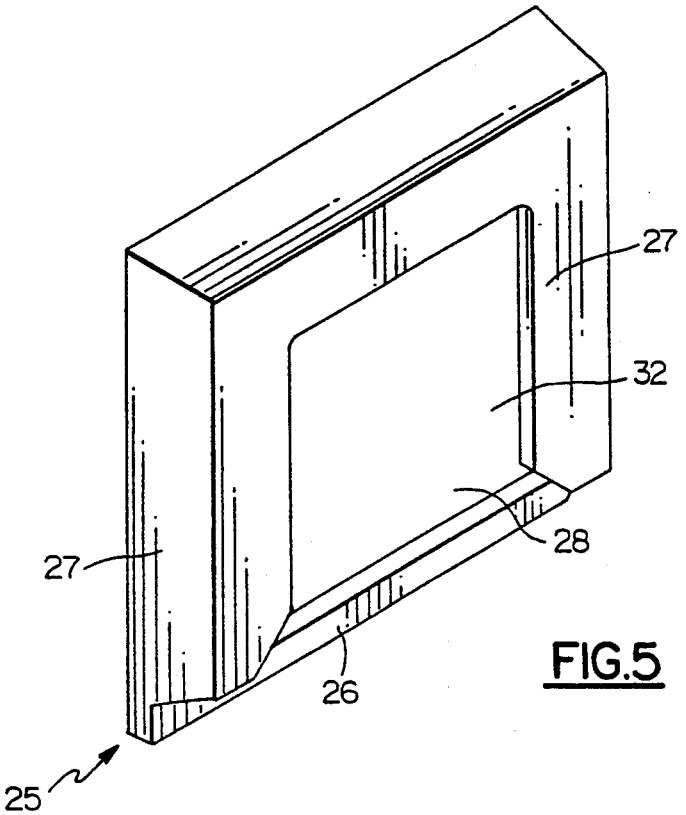
FIGS. 5 and 6 are back and front perspective views of the picture holder element of this embodiment.
Figure 6:
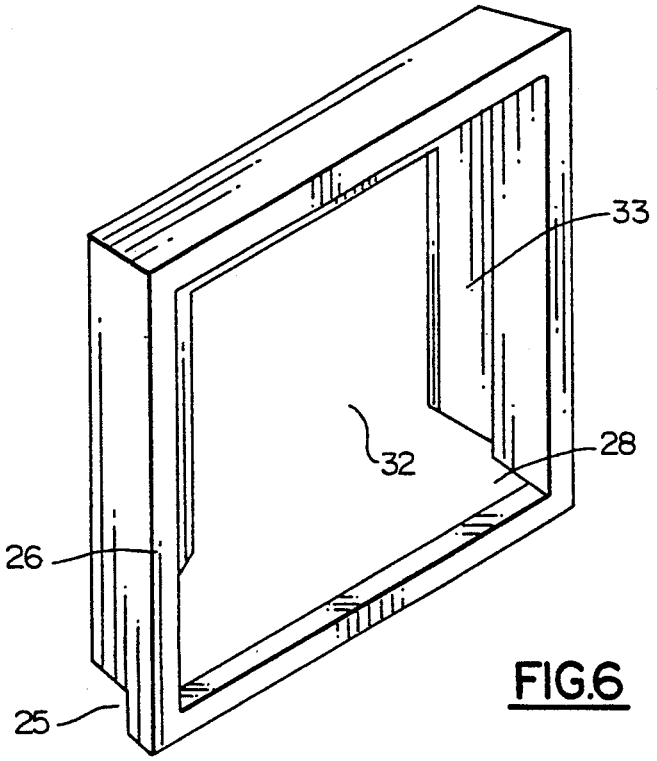

A square of double-sided adhesive tape 24 is applied to the proximal side of the back grid 15 on the wide web members 18 that surround the back picture opening 19. Then, a one-piece picture holder member 25 is secured by this square of double-sided tape 24 to the assembly formed of the front and back grid members and the marbles or spheroids. The picture holder member 25 is preferably formed as a casting of zinc or zinc alloy, although it is equally possible to be molded of a synthetic resin material. The casting has a front or distal square plate member 26 as shown in FIGS. 5 and 6, with a flat front or distal surface which is secured by the tape 24 to the webs 18. There is also a proximal retaining wall 27 which overhangs on three sides, leaving an open fourth side 28, here disposed downwards. A glass square 29, one or more backing pads 30, and a frame back 31, here with an easel stand, are inserted through the open side 28 and retained in the picture holder member 25.

As further shown in FIGS. 5 and 6, the retaining wall 27 has three slanted sides and a generally axially extending proximal wall which defines an opening or slot 32 which receives the glass 29, the backing pads 30, the frame back 31, and any artwork or picture. The square front member 26 defines a square opening 33 at the front or distal side of the picture holder member 25. This opening 33 is somewhat larger than the back picture opening 19 as defined by the webs 18, so that a portion of each of the webs 18 extends over the edges towards the center of the opening 33. Thus, the wide web members 18 serve as a front wall to retain the glass 29 and other elements within the picture holder member.

The printer frame of this invention can now be seen to be of a relatively simple construction. The grids 11 and 15 can be laser cut of a decorative sheet metal or can be die cut, or can be molded of a plastic material, if desired. The picture holder member 25, here die cast of zinc or zinc alloy, is of one piece construction and can be easily manufactured. Alternatively, this picture holder member can be molded of a synthetic resin, or can be constructed of other suitable materials. As mentioned above, the spheroids 14 can be glass marbles, hollow or solid plastic, ceramic, or metal spheres, either translucent, transparent, opaque, or opalescent. Also, the spheroids 14 need not be round, smooth spheres, but can be textured, or can be polyhedrons rather than spheres.

Figure 9:
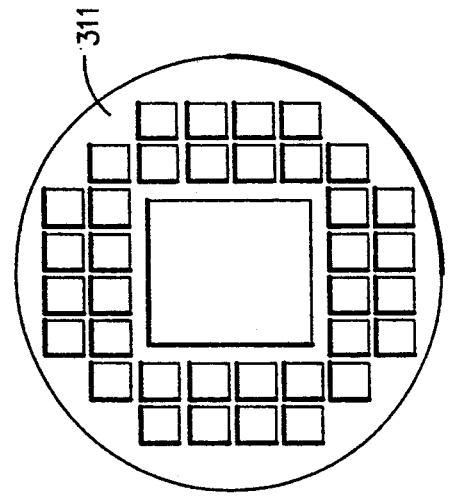
FIGS. 7–12 are elevations of the front grid members according to respective alternative embodiments of this invention.
Figure 12:
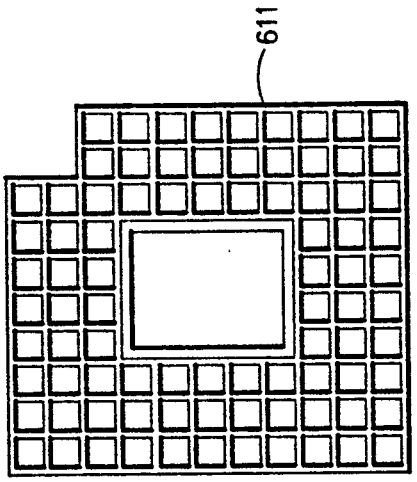
Figure 8:
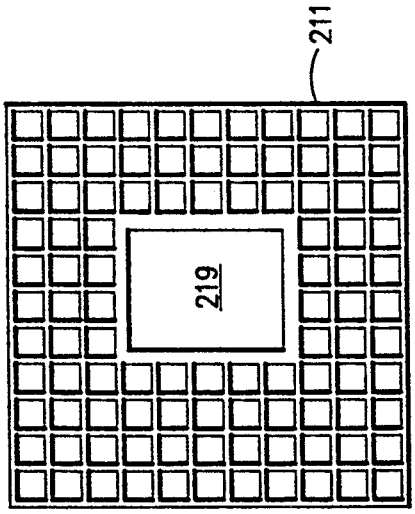
Figure 11:
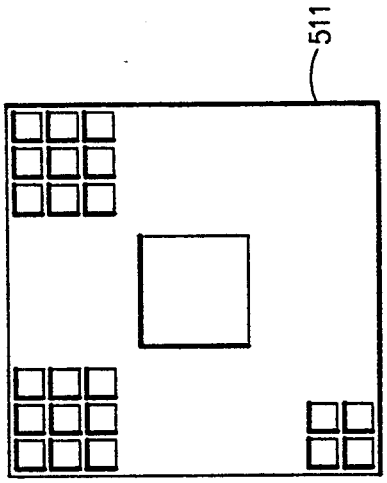
Figure 7:
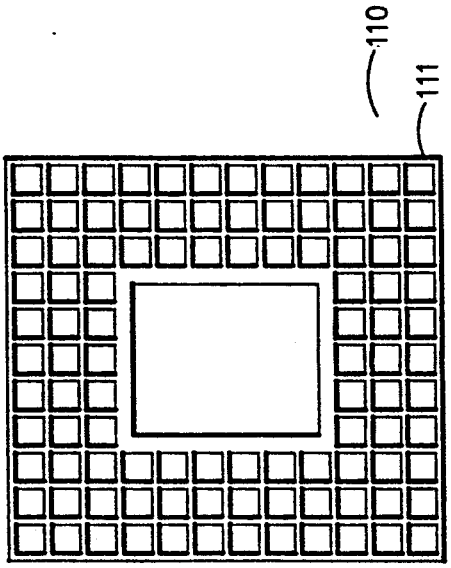
Figure 10:
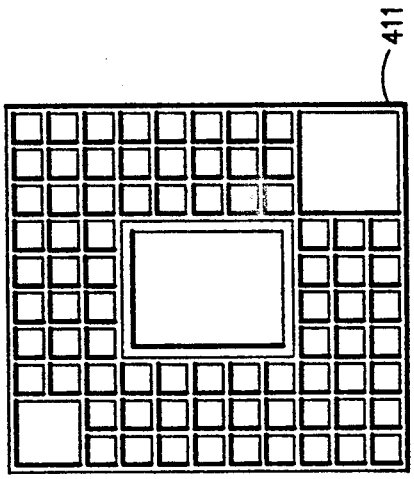

In addition to the form of the grid members described above, of square shape and symmetrical, a number of variants are possible, of which a few examples are shown in FIGS. 7, 8, 9, 10, 11, 12. For example, as shown in FIG. 7, a frame member 110 can have its front grid 111 elongated in one direction. As shown in FIG. 8, the front grid member 211 can have different numbers of rows of openings on one side or the other of the corresponding opening 219. Further, the frame need not be square or rectangular, but, as shown in FIG. 9, can have a round grid member 311 or alternatively can be oval, amoeba-shaped, or triangular. As shown in FIG. 10, the frame may have grid members 411 arranged with different sizes of grid holes or openings to accept different sizes of spheroids. Similar to what is shown in FIG. 10, the frame can be arranged to accept more than one picture. As shown in FIG. 11, the frame can also be arranged with a grid member 511 having openings appearing only in selected portions of the margins thereof, or, as shown in FIG. 12, the grid members 611 can have some portions of the grids 611 cut away to achieve an unusual shape. Also, the grid openings need not be square, but can be oblong or rounded.

Figure 13:
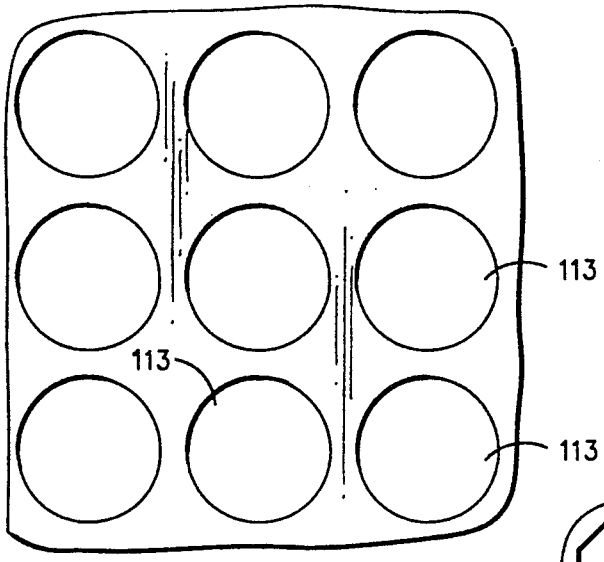
FIGS. 13, 14, and 15 show variations of grid opening structure.
Figure 14:
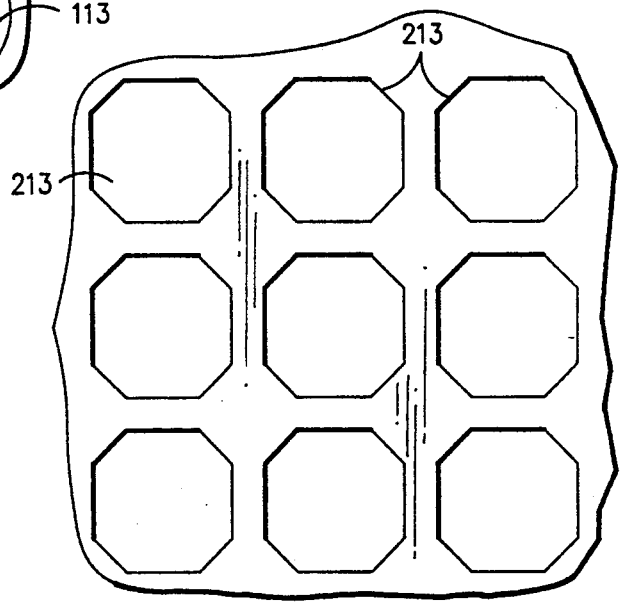
Figure 15:
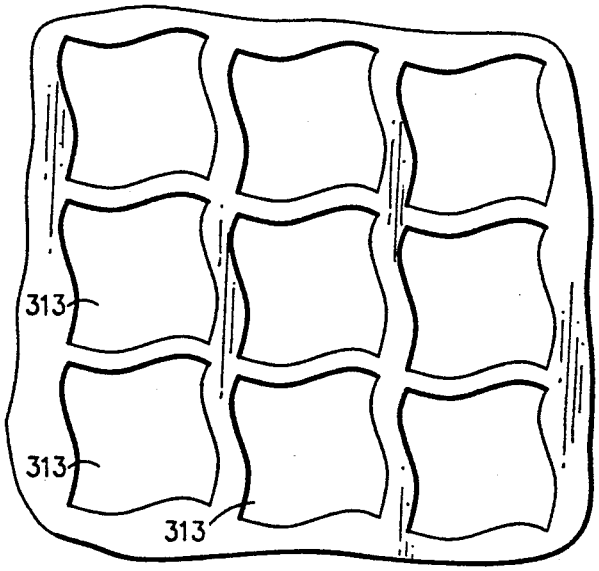

In addition to the above variations, others are possible. For example the grid openings need not be in the form of circles 113 (FIG. 13), octagons or other polygons 213 (FIG. 14), or arbitrary geometric shapes 313 (FIG. 15).

Figure 18:
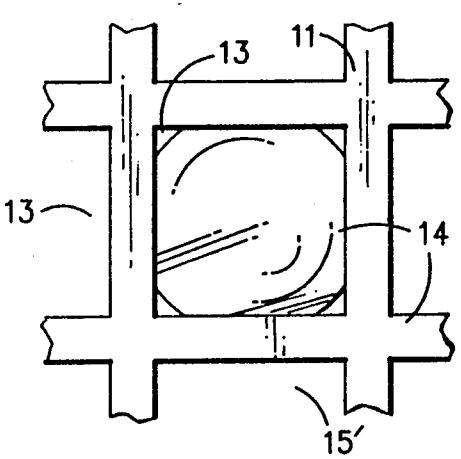
FIGS. 18 and 19 are partial front elevation and cross sectional views of a further embodiment of the invention.
Figure 19:
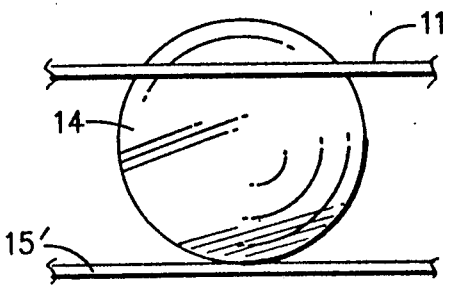
Figure 16:
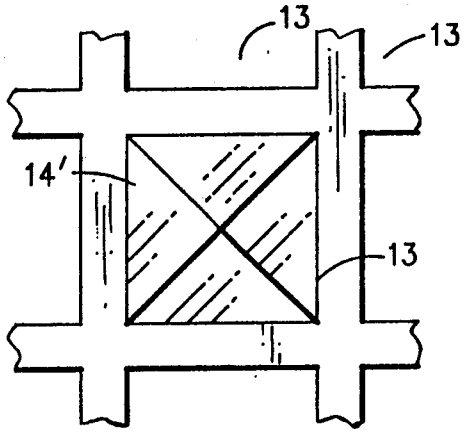
FIGS. 16 and 17 are partial front elevation and cross sectional views of another alternative embodiment of the invention.
Figure 17:
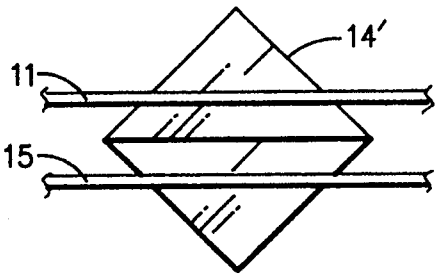

Rather than marbles or spheroids as depicted previously, it is possible to employ beads (or other geometric solid shapes) such as dice or cubes, octahedrons, pyramids, hemispheres, etc. In FIGS. 16 and 17, an octahedron shaped bead 14' is held between the front and back grids 11, 15, and fits snugly into the square grid opening 13. As shown in FIGS. 18 and 19, an unperforated back grid member 15' can be used. This can be a mirror or glass or other planar surface. Here the front grid 11' suffices to hold the marbles, beads or spheroids in place.

While the invention has been described in detail with respect to a preferred embodiment and a few selected variants thereof, it should be understood that the examiner is not limited to such embodiments. Rather, many modifications and variations would present themselves to those of skill in the art without departing from the scope and spirit of this invention, as defined in the appended claims.

What is claimed is:

1. A picture frame comprising a front grid member having a plurality of intersecting strips formed thereon to define a plurality of grid openings in a margin surrounding a picture opening, said grid openings having a predetermined grid spacing between adjacent ones of said openings and a predetermined opening size thereacross; a back grid member having a similar plurality of intersecting strips to define a similar plurality of grid openings in a margin surrounding a back grid member picture opening; a plurality of spheroids of a predetermined diameter between said grid opening size and said grid spacing, and retained in an array between said front and back grid members in the margins thereof; fastener means holding said front and back grid members in registry with one another with said spheroids disposed therebetween in respective ones of said grid openings; and a picture holder member secured to one said grid member at the picture opening thereof.

2. A picture frame according to claim 1 wherein said grids are in the form of a rectangular lattice.

3. A picture frame according to claim 1 wherein said spheroids include transparent spheres.

4. A picture frame according to claim 1 wherein said fastener means includes a plurality of threaded posts affixed at predetermined locations on said front grid members and which project through openings at intersections of said strips of said back grid members, and respective nuts for securing onto said posts.

5. A picture frame according to claim 1 wherein said picture holder includes a one-piece casting having rectangular member with a front flat surface and a retaining wall formed on three sides of said rectangular member, with a fourth open side.

6. A picture frame according to claim 5 comprising a segment of adhesive tape with adhesive on both surfaces bonding the picture holder to the back grid member.

7. A picture frame according to claim 6 wherein said segment includes a rectangle of said tape adhering to said front flat surface.

8. A picture frame according to claim 6 wherein said rectangular member defines a front rectangular opening in said picture holder, said picture holder opening being larger than back grid member picture opening so that said back grid serves as a front wall for said picture holder.

9. A picture frame comprising a front grid member formed as a plurality of margin panel members surrounding a central picture opening, said margin panel members having therein an array of grid openings having a predetermined grid spacing between adjacent ones of said openings and each opening having a predetermined size thereacross; a back grid member formed of a similar plurality of margin panel members surrounding a back grid member picture opening; a plurality of beads of a predetermined diameter between said grid size opening and said grid spacing, and retained in an array between said front and back grid members in the margin panel members thereof; fastener means holding said front and back grid members in registry with one another with said beads disposed therebetween positioned in respective ones of said grid openings; and a picture holder member secured to one said grid member at the picture opening thereof.

10. A picture frame according to claim 9 wherein said grid openings are square.

11. A picture frame according to claim 9 wherein said grid openings are round.

12. A picture frame according to claim 9 wherein said grid openings are polygonal.

13. A picture frame according to claim 9 wherein said beads are spherical.

14. A picture frame according to claim 9 wherein said beads are polyhedrons.

15. A picture frame according to claim 9 wherein said back grid member is provided without grid openings.

* * * * *